US010039398B1

(12) United States Patent
Daneshvar

(10) Patent No.: US 10,039,398 B1
(45) Date of Patent: Aug. 7, 2018

(54) DANESHVAR'S CAKE COVERS AND METHODS

(71) Applicant: Yousef Daneshvar, West Bloomfield, MI (US)

(72) Inventor: Yousef Daneshvar, West Bloomfield, MI (US)

(73) Assignee: AMERICAN MEDICAL CORPORATION

( * ) Notice: Subject to any disclaimer, the term of this patent is extended or adjusted under 35 U.S.C. 154(b) by 61 days.

(21) Appl. No.: 13/964,035

(22) Filed: Aug. 9, 2013

(51) Int. Cl.
*F21V 35/00* (2006.01)
*A47G 19/26* (2006.01)

(52) U.S. Cl.
CPC ..... *A47G 19/26* (2013.01); *F21V 35/00* (2013.01)

(58) Field of Classification Search
CPC . F21V 35/00; F23D 3/16; C11C 5/002; C11C 5/006; C11C 5/008; C11C 5/023; F21W 2121/00; F21W 2121/002; A47G 2400/061
USPC ..... 431/288–297
See application file for complete search history.

(56) References Cited

U.S. PATENT DOCUMENTS 1,125,855 A * 1/1915 Mapes ..... A47G 19/26 312/284
1,935,831 A * 11/1933 Cunningham ..... F21V 35/00 426/128
2,468,505 A * 4/1949 McNeill ..... F21V 35/00 362/382
2,594,403 A * 4/1952 Crimmins ..... A47G 23/06 431/156
2,758,458 A * 8/1956 Carlson ..... A47G 19/26 312/280
2,811,030 A * 10/1957 Tannahill ..... F21V 35/00 428/7
2,924,330 A * 2/1960 Ballard ..... A47G 19/00 206/493
2,960,770 A * 11/1960 Valenta ..... 33/1 F
3,736,214 A * 5/1973 Birnie ..... A47G 19/26 312/284
D256,844 S * 9/1980 Conn ..... D1/129
D285,159 S * 8/1986 Wexler ..... D7/610
4,884,966 A * 12/1989 Wexler ..... A47G 19/26 312/284

(Continued)

FOREIGN PATENT DOCUMENTS

FR 2592782 A1 * 7/1987 ..... A47G 19/00

OTHER PUBLICATIONS

Google Translate, Machine Translation of FR2592782A1, Retrieved Mar. 21, 2016.*

*Primary Examiner* — Avinash Savani
*Assistant Examiner* — Deepak Deean

(57) ABSTRACT

The birthday parties are part of happy occasions and commonly a cake is utilized with numbers of candles on its top for being burned and blown out by the birth day person. However, some guests consider that in this process multiple numbers of microscopic units of saliva and mouth contents are also blown to the cake and do not like eating pieces of such cakes. Thus in this invention introduces a cover for the cakes which is impermeable and non inflammable, and has a series of cradles that will hold candles in sturdy fashion for being blown away without falling and even if they fall or at the end of their burning they would not be able to cause fire. Thus allowing eliminating the problem mentioned.

19 Claims, 8 Drawing Sheets

(56) References Cited

U.S. PATENT DOCUMENTS 4,938,688 A * 7/1990 Wexler ..... A47G 19/26 312/284
D333,410 S * 2/1993 Panzarello ..... D7/610
D490,276 S * 5/2004 Pereira ..... D26/10
6,892,883 B1 * 5/2005 Brumfield et al. ..... 206/459.5
D512,878 S * 12/2005 Slagter ..... D7/610
7,503,456 B2 * 3/2009 Rodriguez ..... B65D 51/245 206/457
8,459,456 B2 * 6/2013 Donnelly ..... 206/457
8,668,088 B2 * 3/2014 Donnelly ..... A47G 19/26 206/457
D712,705 S * 9/2014 Fitzpatrick ..... D7/610
D713,694 S * 9/2014 Fitzpatrick ..... D7/610
2003/0136277 A1 * 7/2003 Okros ..... A47G 19/26 99/645
2004/0244604 A1 * 12/2004 Slagter ..... A47G 19/26 99/485
2005/0056162 A1 * 3/2005 Milligan ..... A47G 19/26 99/645
2005/0087459 A1 * 4/2005 Slagter ..... 206/227
2005/0239007 A1 * 10/2005 Dell'Aquila ..... F21S 6/001 431/125
2007/0048680 A1 * 3/2007 Cartledge ..... A47G 19/26 431/126
2008/0268392 A1 * 10/2008 Bern ..... A47G 19/00 431/295
2009/0181335 A1 * 7/2009 Tropeano ..... 431/253
2012/0247996 A1 * 10/2012 Donnelly ..... A47G 19/26 206/457
2014/0272743 A1 * 9/2014 Hill ..... A47G 19/26 431/295

* cited by examiner

*The Best Dad*

*In the World.*

DANESHVAR'S CAKE COVERS AND METHODS

This is a non-provisional application based on provisional application No. 61/742,392 filed on Aug. 10, 2012.

THE BACK GROUND OF THE INVENTION

Normal life has multiple happy occasions and one of them is celebrating a birthday, in which a cake is commonly utilized with a number of candles placed on it for being burned and blown out by the birthday person. However, many of the guests consider that in the process of blowing multiple numbers of microscopic droplets of saliva and pieces of the mouth contents are also blown toward the cake. This thought creates a very uncomfortable feeling in some guests. Whether these small particles reach to the cake or they have health significance turns not to be the issue; the issue is that in this age of time with many people having very particular feelings about their health and well beings, they prefer not to eat from a cake which, per their perception, is sprayed with small particles from the mouth of the blower. This invention is to eliminate such bad feelings with certainty.

BRIEF EXPLANATION OF THIS INVENTION

In this invention, the applicant introduces a cover for the cakes which is impermeable thus does not allow the particles to pass through. Also, are made from a material such as aluminum foil which is non inflammable; thus, preventing fire if a burning candle falls on. This unit is customized with having cradles and means that allow number of candles to be placed on or inside these cradles or means so that they can be sturdy for being blown away without falling. This unit may have the shape of a cake cover or may be placed on and attached. Special candles will be used to allow a proper presentation of the ages. This cover can be also made from a layer of aluminum foil, shaped and sized to sit alone on the cake or designed to sit on top of the regular clear cake covers available in the market.

THE BRIEF EXPLANATION OF THE FIGURES

FIG. 1. Shows the top view of a non-inflammable layer designed for being placed on top of cake cover.

FIG. 1A. Shows the side view of the unit shown at FIG. 1. Except it have only one small and one larger cradles.

FIG. 2. Shows the top view of a unit similar to one shown at FIG. 1 designed to be placed on an existing cake cover.

FIG. 2A. Shows schematically the side view of a unit similar to FIG. 1A. Except in this model the relatively flat unit has two cradles which are located on its top surface.

FIG. 3. Shows schematically, the side view of the middle unit 4 shown in FIG. 2.

FIG. 4. Shows the top view of the unit shown in previous FIG. 3 with six spaces for six small candles.

FIG. 5. Shows the side view of a commonly used cake cover which is modified by placement on a unit similar to one shown in FIG. 1.

FIG. 5A. Shows schematically the top view of the unit shown at FIG. 5.

FIG. 6. Shows the top view of a unit similar to one shown in the middle of the FIGS. 5 and 5A. Except this is more expanded and modified.

FIG. 7. Shows schematically an angular view of a unit similar to one shown at FIG. 2A. Which consists of a relatively flat unit similar to the unit shown in FIG. 1 or units shown at number 4 shown at FIGS. 2, 5, 5A and 6.

FIG. 8. Shows schematically an angular view of a unit similar to one shown at FIG. 7. Except this unit has two pins shown 8 and 8A allowing one small and one larger candle to be placed.

FIG. 9. Shows the side view of a small size candle designed to represent one year of life of a living body.

FIG. 10. Shows the side view of a medium size candle designed to represent 5 years of life of a living body.

FIG. 11. Shows the side view of a large size candle designed to represent ten years of life of a living body.

FIG. 12. Shows symbolically an ornament, statue or similar object for being placed on the cake cover.

FIG. 13. Shows symbolically a card or plaque or information means which may be placed on the cake cover.

DETAILED EXPLANATION OF THE INVENTION

Normal life has multiple happy occasions and one of them is celebrating a birthday, in which commonly a cake is utilized with numbers of candles placed on it for being burned and then to be blown out by the birth day person. However, numbers of the guests nowadays consider that in the process of blowing of the cake multiple numbers of microscopic droplets of saliva and pieces of the mouth contents are also being blown toward the cake and will sit on it. This thought creates a very uncomfortable feeling in those guests. Whether these small particles reach to the cake or not or they have any health significance turns not to be the issue, the issue is that in this age of time with many people having very particular feelings about their health and well beings or what they eat, prefer not to eat from the cake which per their perception is sprayed with small particles from the mouth of the blower. This invention is to eliminate such bad feelings with certainty. In this invention the applicant introduces a cover for cake which is impermeable thus does not allow the particles to pass through also it is made from a non-inflammable material such as aluminum foil or any other material, so that when a candle is placed it will not cause a fire if it falls on the surface of this cover for the cake and continues to burn. Although in simple models these units even may be made from a layer of special paper or PVCs but in general they have means that will prevent the surface of these covers to burn. Such modification of paper, PVCs or alike may be done by spraying the surface of the covers with a material that will not burn at least will resist burning significantly. Importantly, this unit also introduces means such as cradles which are customized to allow numbers of matching candles to be placed on these cradles so that the candles will stay sturdy and securely in place during the celebration process and allow them to be burned and blown away safely. Such a cake cover unit may be made to be a flat piece, to be placed on the top of the surface or adhere to the top of the cover of the cake, or they may be made to be shaped and have the shape of a cake cover so that it can be placed on the cake. Also of interest are special candles which are designed to allow the age of the birthday person to be properly presented. One model of such covers may be made from a layer of aluminum foil of suitable thickness which is shaped and sized to sit alone on the cake or designed to sit on the top of a commonly used cake or food covers available in the market. For the details of these models, please review the FIG.s.

FIG. 1 shows schematically the top view of a relatively flat unit made of a layer of shapeable, noninflammable material such as aluminum foil or similar, designed for being placed on top, over or being adhered to the top surface of an existing cake or food cover. So that at the time of use this unit will be placed on the top of an existing cake cover and it will be fixed securely to the existing cake cover by use of numbers of attachment means such as adhesive tapes shown at 2 and 2A which will adhere to top surface or the side walls of a regular cake cover to keep this unit on the cake cover securely. Please note that the cake covers are commonly a clear layer of PVC which has top and side walls and stands on the top of the cake and prevents it from being touched or contaminated. The top surface of this unit 1 shown in this FIG. has a series of certain means, cradles (i.e. receptacles) or spaces 3 and 3A designed for placement of number of matching candles inside them securely. These cradles consist of a first series, or group, of small sized cradles 3 and second series, or group, of large sized cradles 3A which are respectively designed to accept small and large candles. The drawing Figure shows that the cradles in group 3 are identical with one another, that the cradles in group 3A are identical with one another, and that a dimensional characteristic (i.e. the diameter) of the cradles in group 3 is different from a corresponding dimensional characteristic (i.e. the diameter) of the cradles in group 3A. It is also apparent from the drawing Figure that group 3 and group 3A are disposed in distinct zones of the sheet, and that the cradles of each group are arranged in parallel rows, with the rows of the first group parallel with the rows of the second group. Group 3 can be considered as being disposed in a distinct first zone and group 3A as being disposed in a distinct second zone outside the first zone. It is also apparent from the Figure that the first and second zones are disposed within an area of the sheet bounded by an encircling perimeter margin of the sheet. A small candle cradle shown at 3 allows a commonly used small candle to sit inside securely and the larger candle cradle/space is shown at 3A. So that a small candle can be securely placed inside the cradle 3 and a larger, predesigned matching candle can be seated comfortably and securely inside the cradle 3A. Thus theses candles will be placed for standing vertically so that they can be burned and blown to turn off by the user. This method of using smaller and larger candles is very important in this invention since in this particular model small candles (total of 10 candles) are designed to indicate symbolically one year of life thus if a boy or a girl is 5 years old 5 small candles will be placed inside these small cradles. The larger cradles shown at 3A holds larger size candles which per design each one will indicate 10 years of life so that if somebody is 32 years old she will have three of the large candles placed in large cradles 3A and two small candles will be placed in the smaller cradles 3. Thus showing the precise age will be possible by this method for a very large group of people. Area shown at A is a surface area designed for placement or attachment of a card, a writing related to the cause of celebration such as "Happy birthday, Caroline." The Figure shows that it is distinctly different from the surface of the perimeter margin of the sheet. Thus, this area allows a written material, a signal, a symbol, an ornament or anything of that nature to be placed on or being attached or adhered on top of this space. A special cradle shown at SC allows a unit with a matching sized base to be inserted and hold vertically for presentation. For example, a photo of the birthday boy or girl may be attached to the top of a matching pole or base, so that the lower end of this matching pole of base will be securely placed inside this cradle in a vertical position to be seen. Special cradle SC and area A are features distinctly different from the cradles of both group 3 and group 3A.

Importantly, the shapes, sizes, the material, coloring and every other important items or means of these units or their parts will vary to allow different models to be made for different uses.

FIG. 1A shows schematically the side view of a unit similar to one shown at FIG. 1. Except in this model the unit is chosen to have only one small cradle 3 and one larger cradle 3A only for allowing the idea to be shown easily also the side view of the special cradle, SC is shown. In this FIG. the relatively flat unit is shown at 1, the side view of one small punched out cradle is shown at 3 and the side view of the larger cradle is shown at 3A as well as the side view of the special cradle, SC. The cradles 3 and 3A have a cylindrical body, their top is open for allowing the candle to be placed inside and the lower base of these cradles may closed or partially or totally being open. The side view of the body of the ef the special cradle, SC is also shown.

FIG. 2. (Please also note FIG. 3) Shows schematically the top view of a unit similar to one shown at FIG. 1, except in this model the flat unit is also made from a relatively flat layer of shapeable, non-inflammable material such as aluminum foil or similar shown at 1, designed for being placed or adhered to the top surface of an existing cake or food cover. At the time of use, this unit will be placed on the top of an existing cake or food cover and it will be fixed securely to the cake/food cover by use of numbers of attachment means such as adhesive tapes 2 and 2A which will adhere to the sides of the top or the side walls of the regular cake/food covers to keep this unit on place securely. The top surface of this unit 1 has another piece attached to it shown at 4 which is a raised/elevated piece so that, for example, it is about one inch higher than the surface of unit 1 and has a body with numbers of cradles designed for placement of numbers of candles inside them securely. Thus the depth of these cradles will be about one inch. The piece 4 is also made from a non-inflammable shapeable material such as aluminum foil which has numbers of smaller 5 and larger 5A cradles designed to accept smaller and larger groups of candles inside its cradles. A small candle shown at 5 allows a small candle to be inserted inside and a larger candle cradle/space shown at 5A for allowing a larger candle to be inserted inside. So that a small candle can be securely placed inside cradle 5 and a larger, predesigned matching candle (meaning, the sizes of the candle and the place of candle will match) can sit securely inside the cradle 5A. These candles will stand vertically in a stable position so that they can be burned and blown off by the user.

This FIG. also shows two pieces of attachment means shown at 6 and 6A which can be made of different means. For example, here the attachment means are adhesive tapes so that the adhesive layer in the lower surface of the attachment means 6 and 6A will allow the piece 4 to be attached to the top surface of the layer 1 securely. Note as an option the piece 4 may be attached to the surface of an existing cake or food cover to function. Again, the method of using smaller and larger sizes of candles is very important since in this particular model small candles (total of 10 candles) are designed to indicate symbolically one year of life. Thus, if a boy or a girl is 5 years old, 5 small candles will be placed inside these five small cradle places. The larger cradles shown at 5A holds larger size candles which per design each one will represent 10 years of life so that if somebody is 32 years old she will have three of the large candles placed in large cradles 5A and two small candles will be placed in the smaller cradles 5. Thus showing the precise age will be possible by this method for a very large group of people. Importantly, one may use the larger cradle for placement of other and different candles so that still symbolically to represent 10 years of age. Even if the size does not match exactly. Importantly, the shapes, sizes, the material, coloring and every other important item of these units will vary to allow different models to be made for different uses.

Also, note the special cradle, SC is also shown. The special cradle allows various means such as statue, symbols, cards, photos or anything of that nature to be placed in this space to be viewed.

Importantly, the cradles or means for holding the candles may have following versions.

1. They may be made to be a punched out spaces without three dimensional walls leaving an empty space with proper size for the candle.
2. They may be made to be punched out spaces with three dimensional walls attached to the lower surface of the cradles.
2. They may be made from an empty cylinder type cradles that are attached to the top surface of the surface 3. As shown in FIG. 2A.
3. They may consist of pins which allow the candles to stick to them.
4. They may be made from adhesive means allowing the candles to adhere to the surface and stand.
5. Importantly, any other methods and means which can be for this purpose may be used.

FIG. 2A. Shows schematically the side view of a unit similar to the unit shown at FIG. 1A. Except in this model the relatively flat unit shown at 1, has two cradles which are located on its top surface. Please note in this model the body of the relatively flat unit is shown at 1, and it has only one small cradle 3B and one larger cradle 3C which are located on the top of the surface of the layer 1. Please also note the upper part of these cradles are open and allows the candles to be placed inside.

FIG. 3. This is a schematic figure and has the purpose to show only the side and top view of the middle unit 4 shown in FIG. 2 which is modified by showing only six small cradles. This piece as mentioned is made of a non-inflammable layer made of a material such as aluminum foil in the shape of a low height cylinder which has at least a top surface, side wall or walls and two attachment means. Note: some parts of the walls may be cut as well. The top view of this unit is shown at FIG. 4. Thus this unit consists of a surrounding vertical wall shown at 7 and a relatively flat top surface shown at number 4. The top surface 4 has only six spaces or cradles in order the view less crowded in this model. One small cradle is shown at shown at 5 which allow a single small candle to be inserted inside and be secure standing vertically. This piece may be secured on the top of the unit shown in FIG. 1 by various attachment means. Here, one such mean is shown at 6 which is an adhesive tape covered with protective cover covering its lower surface so that by removal at the adhesive tape can be exposed and allow this unit to be attached to the surface of any properly-sized cake/food cover or the unit shown at FIGS. 1-2. Importantly, this unit may be used alone and attached to the top surface of a regular cake cover to function.

FIG. 4 shows schematically the top view of the unit shown in previous FIG. 3 again this unit is made from a non-inflammable material such as aluminum foil and has numbers of spaces/cradles one shown in 5 that allows a matching candle in this case up to six small candles to be placed on this unit and to be held vertically and sturdy. The attachment means are shown in 6 and 6A. The Area shown at A is designed for attachment of a greeting card or a writing related to the cause of celebration such as "Happy birthday, Caroline", etc. Thus, this area will allow a written material, sign, symbol, or anything of that nature to be placed on or being attached or adhered on top of this space. Importantly, this unit also may have numbers of larger candle cradles and also special space SC as well to function.

FIG. 5 shows schematically the side view of the commonly used cake cover, CC which is modified by placement of a unit similar to the unit shown in FIG. 1 which has proper size and with some modifications and adjustments. So that the unit made from a thin, non-inflammable material such as aluminum foil shown at 1 is folded and shaped to create walls and assume the shape of the cake/food cover and also to sit on the top and sides of cake cover, CC on a sturdy basis. This is possible with engineering and using proper size and means so that this unit is designed to allow such placement and fitting to happen. The top surface of this unit has the piece 4 with a number of spaces/cradles such as one shown symbolically at 5 that allows a matching candle in this case only one is shown to be placed on this unit and to be hold vertically and sturdy. One of the attachment means which holds the piece 4 on the top of piece 1 is shown in 6. The attachment means 2A attaches the created side wall of piece 1 to the cake cover CC. Note: a single cradle is chosen to prevent this FIG. from being crowded and confusing. Note the side wall 1A is created by folding the sides of the piece 1.

FIG. 5A shows schematically the top view of the unit shown at FIG. 5. Shows the body of the flat piece 1 with the raised central piece 4, the cradle 5 and attachment means 6 and 6A are also shown.

FIG. 6 shows schematically the top view of a unit similar to the unit shown in the middle of the FIGS. 5 and 5A. Except this is a more expanded and somewhat modified unit which shows more numbers of the cradles 5 and 5A and also shows the information area A. This unit is also made from a thin layer of a non-inflammable material such as aluminum foil and also has a height which could not be viewed in this FIG. It has ten small spaces/cradles shown at 5 for placing ten small candles, which are sized to allow a small, commonly used candle to fit inside and be held vertically and sturdy, as well as eleven large candle cradles one shown at 5A, which allows larger candles to fit inside, to be held vertically and sturdy. The attachment means are shown in 6 and 6A and they allow this unit to be secured.

A. On the top surface of a commonly used cake/food cover.
B. On the top surface of unit shown at 1 and 2.
C. On the top of a chocolate body, box or container.
D. On top of a Jello body, box or container.
E. On top of any other rather relatively flat surfaces such as tables and similar.

The area shown at A is designed for placement or attachment of a greeting card or writing related to the cause of celebration such as "Happy birthday, Caroline" and similar. Thus, this area will allow a written material, sign, symbol or anything of that nature to be placed on or be adhered to this space. This unit may have the special space, SC shown previously and explained. FIG. 7 shows schematically an angular view of a unit similar to one shown at FIG. 2A. Which consists of a relatively flat unit similar to the unit shown in FIG. 1 or units shown at number 4 shown at FIGS. 2, 5, 5A and 6. Except this unit is chosen with only two cradles 7 and 7A which are located on its top surface. Please note in this model the body of the relatively flat unit is shown at 1, and it has only one small cradle 7 and one larger cradle 7A which are located on the top of the surface of the layer 1. Please also note the upper part of these cradles are open and will allow s mall and large candles to be inserted into these cradles.

FIG. 8 shows schematically an angular view of a unit similar to one shown at FIG. 7. except this unit has two pins shown 8 and 8A which are located on top surface of the unit 1 and are designed to allow two candles one small to be placed in pin 8 and one larger candle to be placed on 8A and be held securely for the use.

Figure 11:
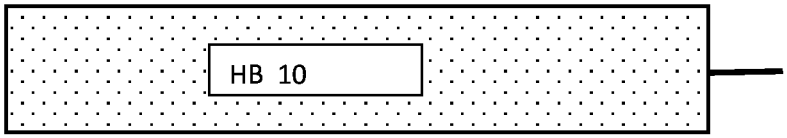

FIG. 11 shows schematically, the side view of a large size candle designed to represent ten years of life of a living body. This unit will fit comfortably and securely inside large cradles shown in these models for such use. Please note various colors, stickers or signals or means may be also used for identification, beatification and classification of the candles.

Figure 1:
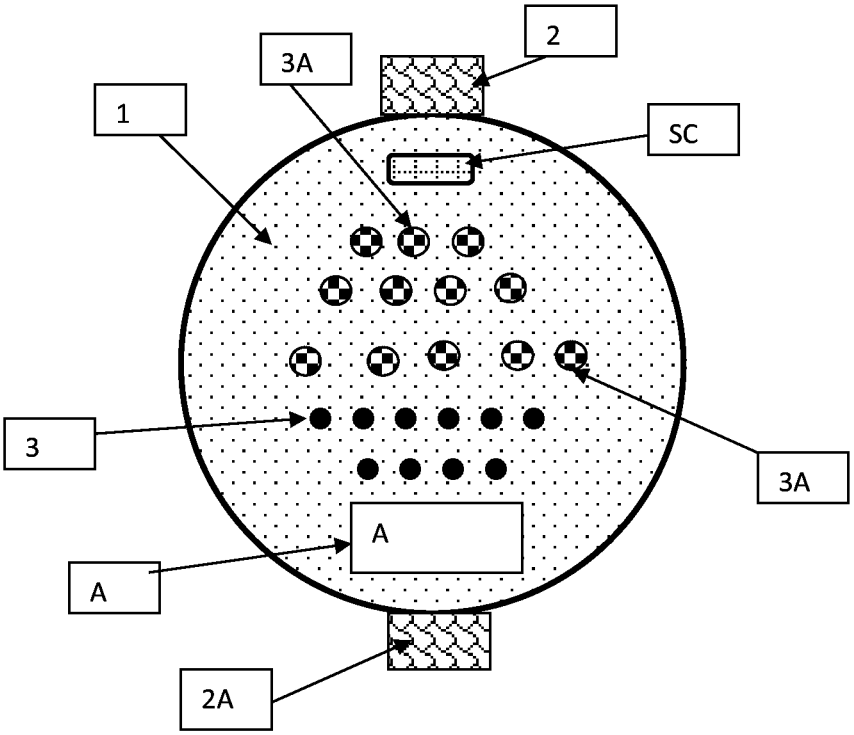
Figure 1A:
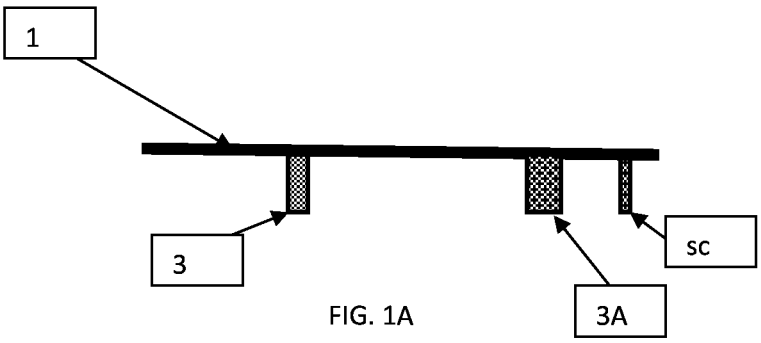
Figure 2:
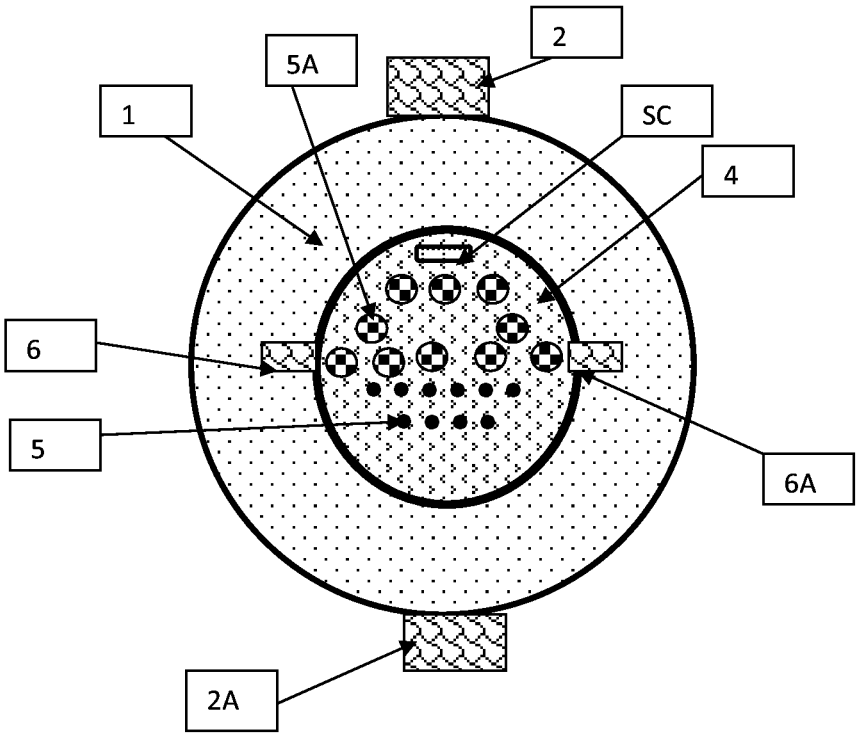
Figure 2A:
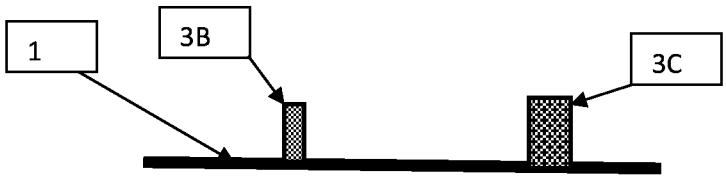
Figure 3:
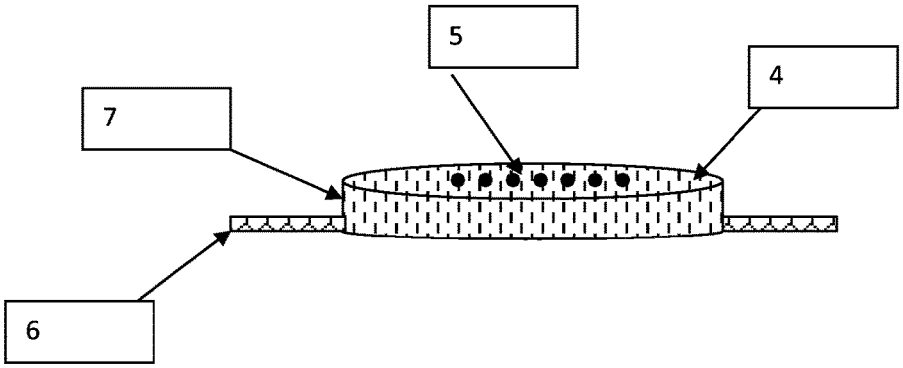
Figure 4:
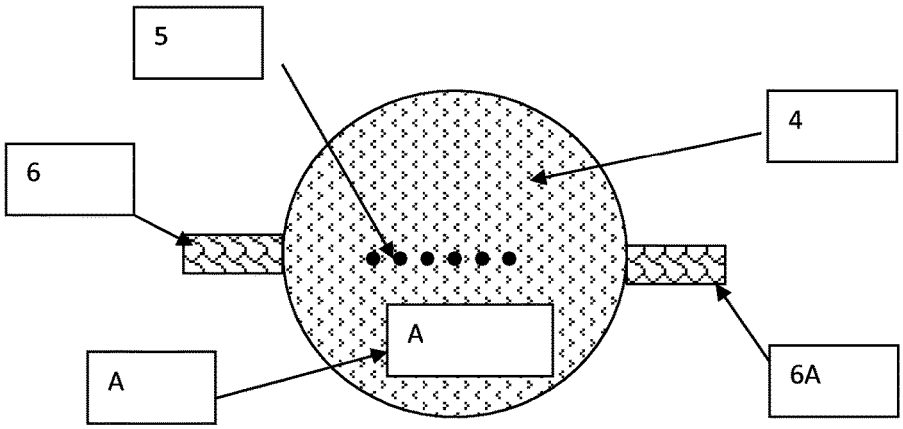
Figures 12, 13:
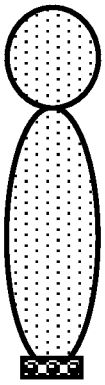

FIG. 12. This figure is to show schematically and symbolically an ornament or a statue which may be chosen by the users to represent their feelings. These units have means in their lower end for placing them on the cake covers which are introduced in this application. The lower end will have the size and means which will fit the size and configuration of the special cradle SC. As shown in FIGS. 1, 1A and 2.

FIG. 13. Shows schematically a plaque or information means which may be also placed on the cake cover. These units also will have proper means in their lower end for being placed on the cake covers which are introduced in this application. The lower end will have the size and means which will fit the size and configuration of the cradles designed to them such as special cradle SC.

Beautification of these units may be made by:

1. Having different configurations and make ups.
2. Having different colorings, paintings, designs FIG.s and similar.
3. Having different writings, symbols and similar.
4. Attaching various photos and similar.
5. Placement of different types of statues, manmade units, and means and similar.
6. Any other objects and ornaments which may be used with these units.

The materials used for these units may vary.

A. They may be made from paper type materials.

B. They may be made from aluminum foils or any other metals which may be used for such purpose.

C. They may be made from silver foil.

D. They may be made from gold Golden foil.

E. They may be made from platinum foil.

F. They may have diamonds and other ornaments and valuables attached to them.

G. They may be made from PVC layers sprayed with non-inflammable materials, paints or similar.

Importantly, the cradles for the candles can have different versions:

1. They may be made from punched-out spaces.
2. They may be made from a cylinder-type empty cradles that can be attached to the surface of the surfaces of the units.
3. They may be made in the shape of pins to allow the candles to stick.
4. They may be made from adhesive means to allow the candles to stick.
5. Or any other methods and means which may be made for this purpose.

The candles may have the following symbols:

A. Small candles to represent one year of age.

B. Medium or larger size candles for representing 5 years of age.

C. Even larger candles to represent 10 years of age.

4. Other candles may be used to show 20 years of age and higher.
5. The candles may have stickers to show the intended ages.

Some more specifications. Please note that:

I. The body of the unit shown at 1 can be rigid in some models or flexible and shapeable in others so that it can be placed on the top of a commonly used cake cover.

Figure 5:
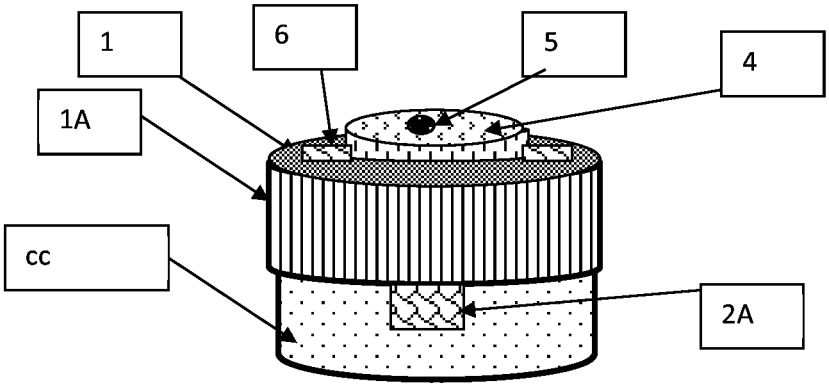
Figure 5A:
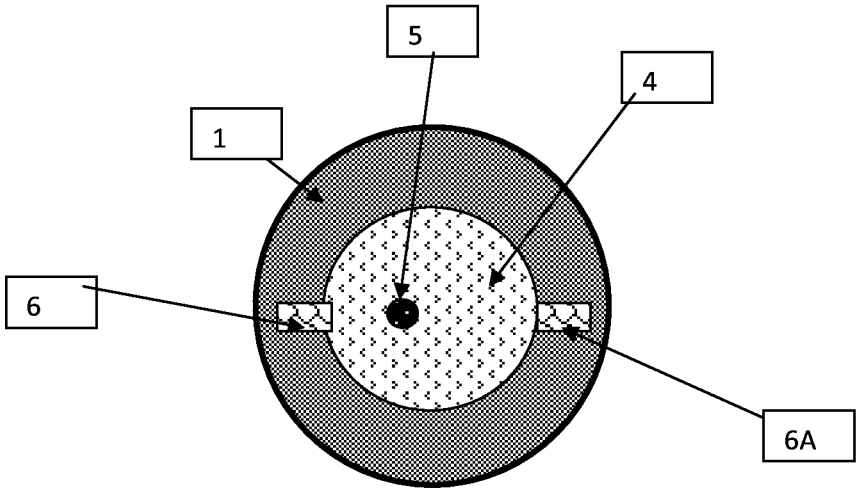
Figure 6:
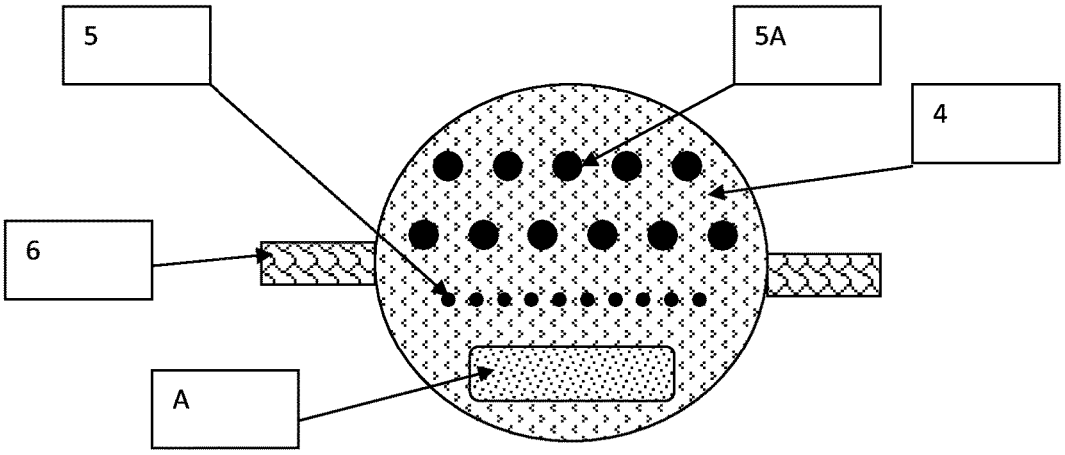
Figure 7:
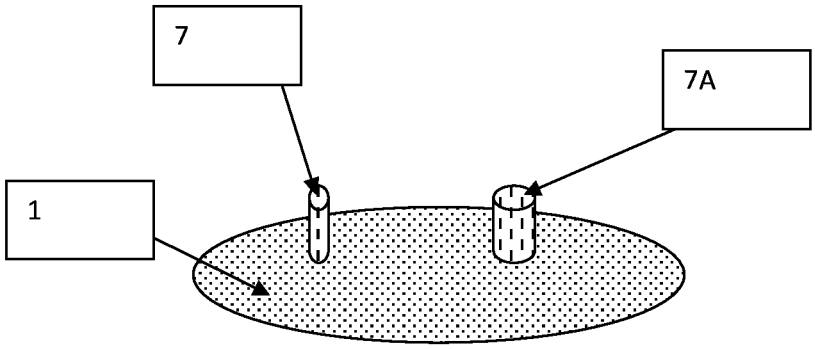
Figure 8:
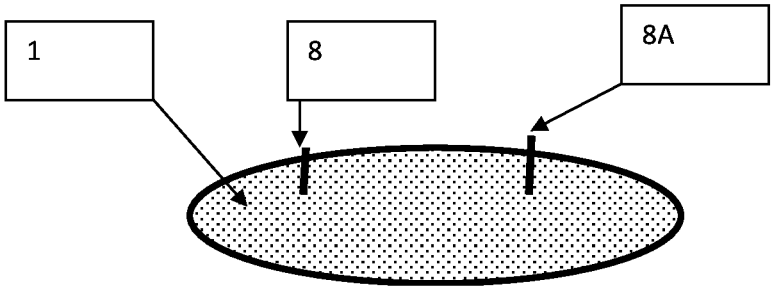
Figure 9:
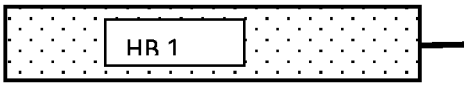
FIG. 9 shows schematically, the side view of a small size candle designed to represent one year of life of a living body. This unit will fit comfortably and securely inside a small cradle shown in the previous figures.
Figure 10:
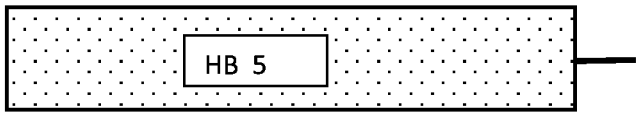
FIG. 10 shows schematically, the side view of a larger size or medium candle designed to represent five years of life of a living body. This unit will fit comfortably and securely inside the medium size cradle designed for such use.

II. The body may assume the shape of the top and sides of a commonly used cake cover as shown in FIG. 5.

III. It may also have adhesive zones on its lower surface to allow sticking to the surface of the cake cover and stay sturdy.

IV. Also importantly, the outer surface of these surfaces may have various colors, paintings, drawings and symbols all used to indicate a message for the celebration.

V. Although the examples are shown for round cake covers, the shapes can be rectangular, cuboid shape or any other desirable or needed shapes, forms and designs.

1. Although the colors may differ, in general, for boys, they may be colored blue and with masculine paintings or photos.
2. The same will be for girls, as well, however in general they may be colored pink, red or similar with all the feminine paintings, photos and similar.

The cake will have a base to sit on. This part may be a flat means, or be made from a cylindrical or cuboid, empty space to allow the cake and or other food such as Jello to be placed inside this empty spaced for use. Dr. Daneshvar recommends Jello for use in birthday parties and similar low calorie sweet materials rather than cakes and similar for preventing the consumption of too many calories and combating obesity, which is the mother of many problems.

Importantly: Please note that various parts of this invention are not shown in a single figure in order to prevent a crowded and confusing figure. However, the presented options may be used in all or some of those models if they will be useful.

By presenting this invention the applicant is providing means so that in the birthday parties and similar people can have the cake and eat it, too.

The invention claimed is:

1. An article for placement in overlying relation to an edible product, the article comprising:

a non-permeable, flame-resistant shapeable metal foil, the metal foil configured to be reshaped upon application to at least one of an underlying edible product and edible food cover, a top of the metal foil comprising a plurality of candle stick holders, each candle stick holder of the plurality of candle stick holders configured to provide upright support of a candle stick when a respective candle stick is placed on a respective candle stick holder, a card holder, and at least one attachment element configured to secure the metal foil to the at least one of the underlying edible product and edible food cover, wherein the plurality of candle stick holders are arranged in a first group of first candle stick holders disposed within a first zone of the metal foil and in a second group of candle stick holders disposed within a second zone of the metal foil, wherein each first candle stick holder of the first group of first candle stick holders has at least one of a first shape and a first size, wherein each second candle stick holder of the second group of second candle stick holders has at least one of a second shape and a second size that is substantially different than the first shape and the first size of the first group of first candle stick holders.

2. The article of claim 1, wherein the at least one attachment element is configured to attach the metal foil to an object separating the metal foil from the edible product.

3. The article of claim 2, wherein the object is a container cover.

4. The article of claim 2, wherein the at least one attachment element comprises a piece of adhesive tape having adhesive covered by a removable tape cover wherein when the removable tape cover is removed from the piece of adhesive tape, the adhesive is exposed to allow the piece of adhesive tape to be adhered to the object.

5. The article of claim 1, the metal foil further comprising a perimeter margin configured to fold down to create a side of the metal foil that encircles the top of the metal foil.

6. The article of claim 1, wherein the plurality of candle stick holders of the first group comprise receptacles into each of which a base of a respective candle stick can be inserted and the plurality of candle stick holders of the second group comprise receptacles into each of which a base of a respective candle stick can be inserted.

7. The article of claim 6, wherein a number of receptacles of the first group comprises up to ten and a number of receptacles of the second group comprises ten, wherein each receptacle of the first group represents a single year, and wherein each receptacle of the second group represents a decade.

8. The article of claim 7, wherein in which at least one of a shape and a size of the receptacles of the first group is sized relative to at least one of a shape and a size of the receptacles of the second group to allow a candle stick base of a defined size to be inserted into the receptacle of the first group but not to be inserted into the receptacle of the second group.

9. The article of claim 7 in which the receptacles of the first group are arranged in substantially parallel rows, and the receptacles of the second group are arranged in substantially parallel rows which are substantially parallel with the rows of the receptacles of the first group.

10. The article of claim 1, wherein the shapeable metal foil is made from an aluminum foil.

11. An article for placement in overlying relation to an edible product, the article comprising:

a non-permeable, flame-resistant shapeable first metal foil, the first metal foil configured to be reshaped to at least one of an underlying edible product and edible food cover, a top of the first metal foil comprising a plurality of candle stick holders, each candle stick holder of the plurality of candle stick holders configured to provide upright support of a candle stick when a respective candle stick is placed on a respective candle stick holder, a card holder; and a non-permeable, flame-resistant second metal foil that underlies the first metal foil, a side of the first metal foil is disposed centrally on the second metal foil, and a perimeter margin of the second metal foil encircles the side of the first metal foil.

12. The article of claim 11 including at least one attachment element for attaching the side of the first metal foil to a top of the second metal foil.

13. The article of claim 12 including at least one attachment element on the second metal foil for attaching the second metal foil to an object for separating the second metal foil from an edible food product.

14. The article of claim 13, wherein the object is a cover of a container.

15. The article of claim 14, wherein the perimeter margin of the second metal foil comprises a fold which creates a downwardly extending side which is spaced outward from the side of the first metal foil and encircles the container.

16. A structure for covering an edible product comprising:

a container having a top wall and a side wall, the container configured to house an edible product; and an article disposed over the container and comprising an upper section of non-permeable, flame-resistant shapeable metal foil having a top and a side extending downward from a perimeter margin of the top and a lower section of non-permeable, flame-resistant material on a central area of which the side of the upper section is disposed leaving a perimeter margin of the lower section uncovered by, and encircling, the upper section; and multiple spaced apart candle stick holders on the top of the upper section for providing upright support of individual candle sticks.

17. The structure of claim 16 in which the lower section comprises a top which overlies the top wall of the container and a side which extends downward from the lower section's perimeter margin and encircles the side wall of the container.

18. The structure of claim 16 in which the candle stick holders are organized and arranged as a first group of receptacles disposed within a first zone and as a second group of receptacles disposed within a second zone outside the first zone; and At least one of a shape and a size of the receptacles of the second group is different from a corresponding at least one of a shape and a size of the receptacles of the first group.

19. The structure of claim 18 in which the number of receptacles of the first group comprises up to ten, the number of receptacles of the second group comprises ten, and the at least one of the shape and the size of the receptacles of the first group is sized relative to the at least one of the shape and the size of the receptacles of the second group to allow candle stick bases of a defined size to be inserted into the receptacles of the first group but not to be inserted into the receptacles of the second group.

* * * * *